United States Patent [19]

Jaeger et al.

[11] 4,202,448

[45] May 13, 1980

[54] EQUIPMENT FOR TRANSPORTING AND/OR STORING TEXTILE BOBBINS

[75] Inventors: Erwin Jaeger, Herzogenrath; Wilhelm Tiefels, Stolberg, both of Fed. Rep. of Germany

[73] Assignee: Saint-Gobain Industries, Neuilly-sur-Seine, France

[21] Appl. No.: 918,572

[22] Filed: Jun. 23, 1978

[30] Foreign Application Priority Data

Jun. 28, 1977 [DE] Fed. Rep. of Germany ..... 2728968

[51] Int. Cl.[2] ..... B65D 71/00

[52] U.S. Cl. ..... 206/392; 206/394; 206/509; 242/130.3

[58] Field of Search ..... 214/10.5 R; 206/391, 206/392, 394, 499, 509; 242/130.3, 134, 136; 224/46 T, 48 A, 48 B, 48 F, 48 W

[56] References Cited

U.S. PATENT DOCUMENTS

| | | | |
|---|---|---|---|
| 2,532,114 | 11/1950 | McGee | 242/130.3 |
| 3,335,858 | 8/1967 | Sibille | 206/392 |
| 3,730,340 | 5/1973 | Neubert | 214/10.5 R X |

FOREIGN PATENT DOCUMENTS

| | | | |
|---|---|---|---|
| 2346145 | 3/1975 | Fed. Rep. of Germany . | |
| 2503914 | 8/1976 | Fed. Rep. of Germany | 214/10.5 R |
| 1549977 | 11/1968 | France | 214/10.5 R |

*Primary Examiner*—L. J. Paperner

*Attorney, Agent, or Firm*—Charles H. Lindrooth; John T. Synnestvedt

[57] ABSTRACT

Carriers adapted to support strand spools in wire type pallets are disclosed. Each carrier comprises a tray having gripping devices or claws for centering the carrier at the intersection of the crossed support wires which comprise the pallet. Tubular supports extending upwardly and downwardly from the central tray are adapted to hold the ends of spools in position on stacked pallets. The lower support is slotted so that it can extend beneath the plane of the pallet. A central bore extending through the supports and the spool tray allows for circulation of air and treatment fluid so that the spools may be treated with steam or other treatment gas while on the pallets.

5 Claims, 5 Drawing Figures

EQUIPMENT FOR TRANSPORTING AND/OR STORING TEXTILE BOBBINS

BACKGROUND OF THE INVENTION

The invention covers a device for transporting and/or storing textile spools, particularly textile glass fiber and thread spools, consisting of a pallet formed typically by crossed bars, with carriers for the textile spools arranged on the pallet, the carriers having projections and recesses on their upper and lower sides for centering and supporting the lower and upper ends of the spool sleeves in such a manner that several pallets with textile spools can be stacked on top of each other.

German Pat. No. 1,962,280 discloses a device for the transportation and storage of yarn spools with spool sleeves, where the individual pallets consist of a encircling frame with crossed bars. At the crossing points, carriers are provided consisting of two plastic pieces, one of which is arranged above and one below the pallet, which are fastened to each other by press buttons, with the bars passing through the crossing points. The plastic pieces have projections and recesses on their upper and lower sides for centering and supporting the lower and upper ends of the yarn spools.

Due to the shallow projections and recesses on the aforementioned known type of device, the centering of the sleeve body is not sufficiently exact. However, exact centering is required, so that, for instance, on a pallet completely filled with yarn spools, another pallet can be placed in such a manner that the upper ends of all yarn spools enter the carriers arranged on the underside of the pallet being deposited. A further disadvantage of the known system is that the locating devices are arranged in the immediate vicinity of the center and are therefore exposed to the high loads imposed by the horizontal forces acting upon the spools, and consequently break off easily. For changing the carrier for the purpose of preparing the pallets for other work, a special tool is required or else the carrier must be destroyed. Due to the fact that two molds are required for the carriers, the device is relatively expensive.

From German Offenlegungsschrift No. 2,503,914 a pallet insert used as a carrier is known which is fastened to latticed pallets formed by shaped bars and consists of two parts connected to each other by glueing or by conical clamping rings or by threads.

Here again the carrier consists of two parts which must be connected to each other by glueing, by cones, positioning rings, positioning screws, nuts, etc., which is time consuming and cumbersome, both in erection and in dismantling. If the two parts are glued together, the carrier cannot be removed from the pallet without destruction.

From French Pat. No. 1,549,977 a device is known wherein the pallet consists of a rectangular frame of wire, with crossed bars in between. There are always two bars arranged at close proximity parallel to each other with a third bar perpendicular to them. The carriers, made of keep-drawn and stamped plate, feature a flange by means of which they are welded to the two parallel bars. This known device did not prove itself in actual operation, because there are very many forms of sleeves and the carriers had to be adapted to these sleeve forms. Also, the manufacture of the carriers from plate is expensive. Further, the manufacturing cost for a pallet is increased by the fact that two parallel bars are always required. Whenever the form of the spool sleeves was changed, the whole equipment made for the previous spool form became unusable and had to be changed.

SUMMARY AND OBJECTS

The objective of the invention is to develop a device of the type indicated above for transporting and/or storing of textile spools with spool sleeves, which is cheaper in manufacture, of robust design, and can be changed easily and at low cost to suit the various spool forms, and at the same time provides great stability of the spools.

In accordance with the invention, the above task is resolved by a one-piece design of the carriers, the latter consisting of a tray which can be placed on the bars of the pallet. On its upper side, the tray has a support for the lower end of the spool sleeve, and on its underside another support that can pass through the pallet, for the upper end of another spool sleeve as well as at least two claws which can be clamped to the bars of the pallet.

The whole device is less expensive to manufacture since only one mold is required for making the carriers. The carrier is simple and of sturdy construction and does not include any parts which would be liable to break off. By designing the carriers in the form of a tray, they are exactly centered and fixed relative to the pallet, so that the spools are very stable when transported and the pallet correspondingly has a considerable lateral stability. The carriers can be easily removed from the pallet by lifting the trays and replaced by new carriers which are designed to suit the changed spool form.

In accordance with a further characteristic, the device is characterized by the fact that the tray is arranged at the crossing points of the bars.

As a result, the carriers sit very securely on the bars of the pallet and the risk of any shifting of the carriers, particularly with heavy spools, is completely eliminated.

In accordance with a particularly advantageous feature of the invention, the claws on the carriers are arranged in the outer third of the tray radius. This design feature also contributes to a firm seating of the carriers on the pallet. Due to the fact that the claws are located in the outer third of the tray radius, the loads imposed by the horizontal forces acting upon the spools are reduced and thus the risk of breakage of the claws is greatly decreased.

According to a further advantageous feature of the invention, the claws consist of two jaws which embrace the bar by means of a rounded groove.

By means of the spring action of the claws, the tray is fastened to the bars of the pallet. By turning the trays sideways, the claws jump out of the bars and release the carrier.

According to a further particularly advantageous feature of the invention, the tray has a central cylindrical bore.

Since the spools must be subjected frequently to treatments, for instance a steam treatment, a bore in the center of the spool is absolutely necessary for free passage of air, in order to attain an even treatment of the fibrous body on the spool sleeve, particularly the yarn and thread body. This is of particular importance if the treatment is to be effected on textile spools which are already stacked on top of each other on pallets, in order to save time and space. In the case of the aforementioned known devices, the carriers have either a very small central bore or no bore at all so that the air cannot freely circulate.

According to another characteristic of the invention, the tray is provided on its outer edge with a flange pointing downwards which has recesses for accommodating the bars.

The flange ensures a safe resting of the tray on the bars and prevents a possible tilting of the tray. In addition, it reinforces the tray, and the latter can therefore be made with a thinner wall thickness which leads to a saving in material.

According to a further feature of the invention the device is characterized by the fact that the support provided on the underside of the tray for accommodating the upper end of the spool sleeve is designed as a bushing with a cylindrical wall and an annular bottom. The bushing is provided with slots that embrace the bars.

Due to the slotted design, the lower support can be easily passed through the pallet.

BRIEF DESCRIPTION OF THE DRAWINGS

Further advantages, design details and features of the invention will become evident from the ensuing description in which two embodiments are explained with reference to the drawings in which.

Figure 2:
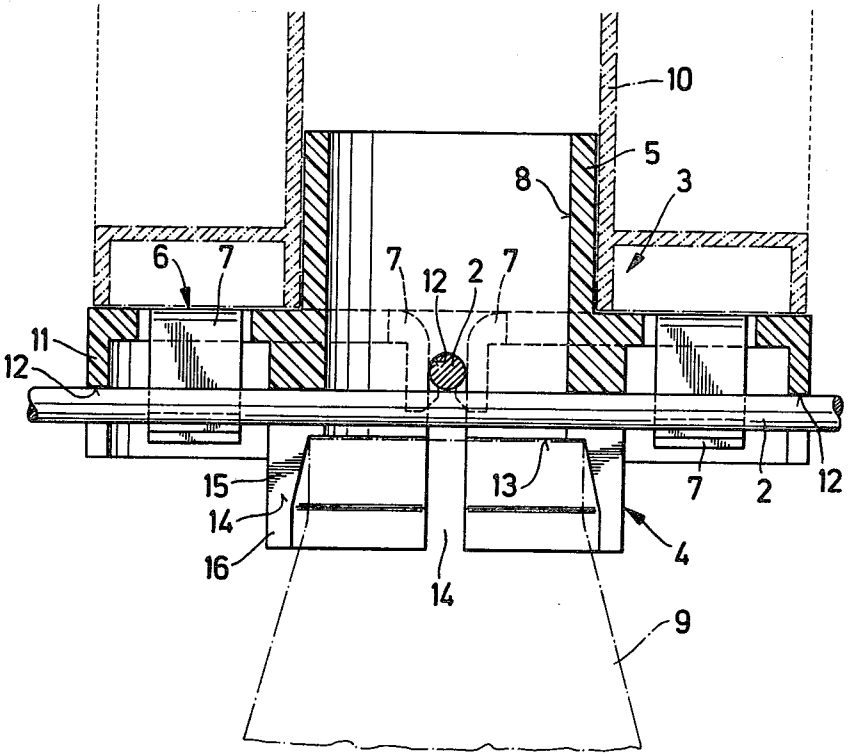
FIG. 2 is a section through a carrier as per FIG. 1.

In the drawing, reference character 1 designates a pallet, consisting of a frame 18 and metal bars 2 crossing each other at a right angle and arranged inside the frame. Although in the example shown the bars cross each other at right angles, they may also be arranged at acute or obtuse angles. Item 3 is the tray that forms the carrier and can be deposited on the bars. It is preferably made of a heat-resisting plastic material, preferably polypropylene, and carries at its upper side spool positioning means comprising a tubular support member 5 which preferably fits within a central opening in the lower end (foot) 10 of the sleeve of a spool or bobbin. At its underside it carries a spool positioning means comprising a tubular member 4 which preferably fits over the upper end (head) 9 of another bobbin. Item 6 represents devices for releasably gripping the metal bars or rods comprising resilient claws extending beneath tray 3 in the outer third of the tray radius. In the example illustrated, four claws are provided. The claws consist of two resilient jaws 7 which extend downwardly from the tray to form a rounded groove which embraces rod 2. According to the position of the crossed bars, the grooving of the jaws is arranged at two different heights for two pairs of jaws, to suit the different height positions of two crossed bars. The trays 3 are clamped to bars 2 by means of the jaws and retain the trays on the pallet. By tilting the tray 3 sideways relatively to the pallet, the claws separate sufficiently to release the bars or wires 2 and thus release the trays 3. They are therefore easily exchangeable, i.e., there is no problem in mounting different trays for different types of sleeves.

Figure 1:
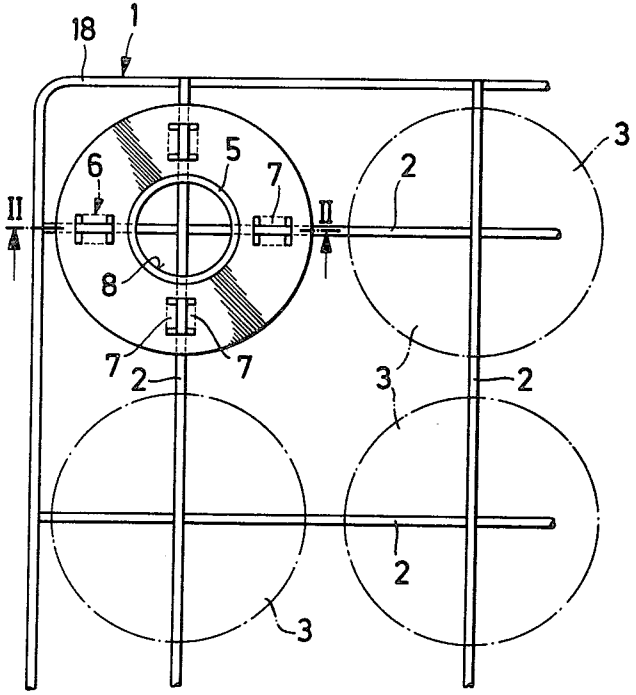
FIG. 1 is a partial plan view of the device with pallet and carriers.

Each tray has a central cylindrical bore 8 whose diameter equals approximately the inside diameter of the upper sleeve end, and through which air or some other treatment medium can freely circulate when the spools are treated, without any need for removing the spools from the pallets. The positioning device 5 for the lower end of a sleeve is preferably of cylindrical shape, whereas the positioning device 4 consists of a tubular element which extends beneath the plane of the pallet and preferably has a cylindrical wall 16 and an annular bottom 13. Slots 14 are provided in the tubular element through which the rods 2 enter when tray 3 is properly positioned on them. In the embodiment shown in FIGS. 1 and 2, the tubular element has at its inside, adjacent to bottom 13, a conical portion 15. By this provision, the upper end of bobbin 9 can be introduced into the tubular element and withdrawn from it. In the illustrative embodiment the inside diameter of the cylindrical part of the tubular element should be at least 10 mm larger than the outside diameter of the upper end or head of the bobbin, to facilitate the stacking and the positioning of the bobbin. The conical part 15 of the tubular element facilitates the centering of the upper end of the spool or bobbin.

At its outer edge, tray 3 is provided with a downwardly pointing flange 11 which has four recesses 12, two of which have a depth corresponding to the position of one of the two rods, and the two others have a depth to suit the other rod. When depositing tray 3 on the rods 2, the flange with its recesses comes to rest on the bars, so that the tray is stabilized in its position and will not tilt even in case of vibrations, such as occur during transportation.

Figure 3:
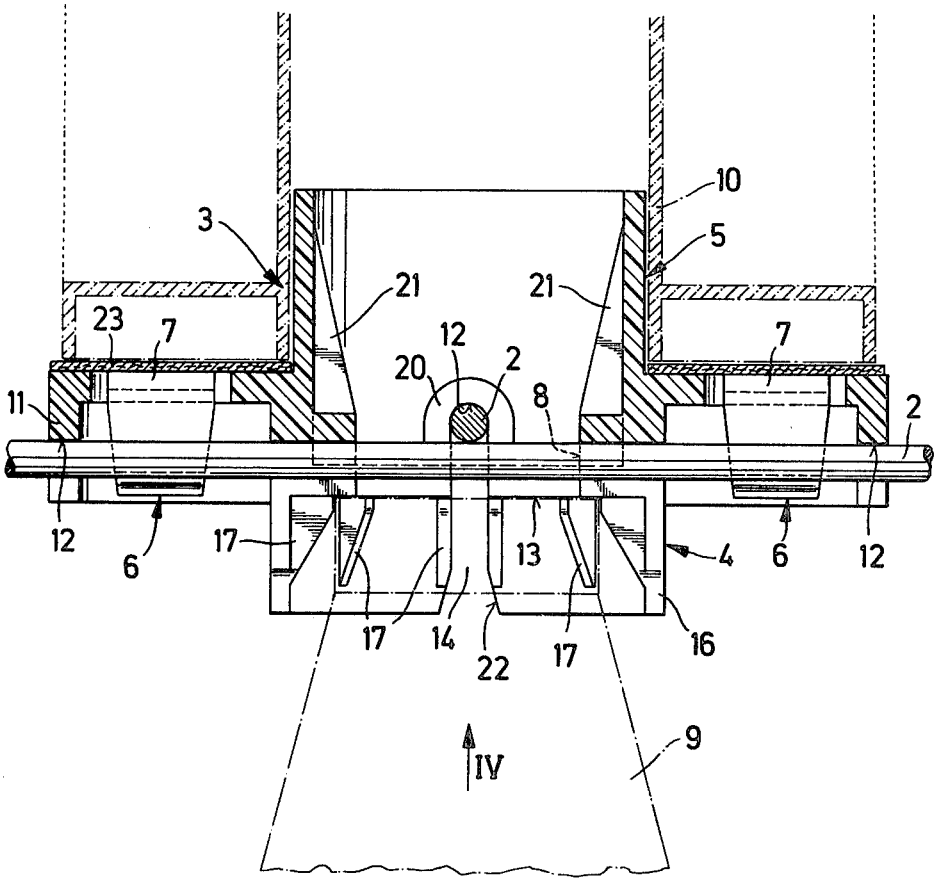
FIG. 3 is a section through a carrier of an alternative embodiment
Figure 4:
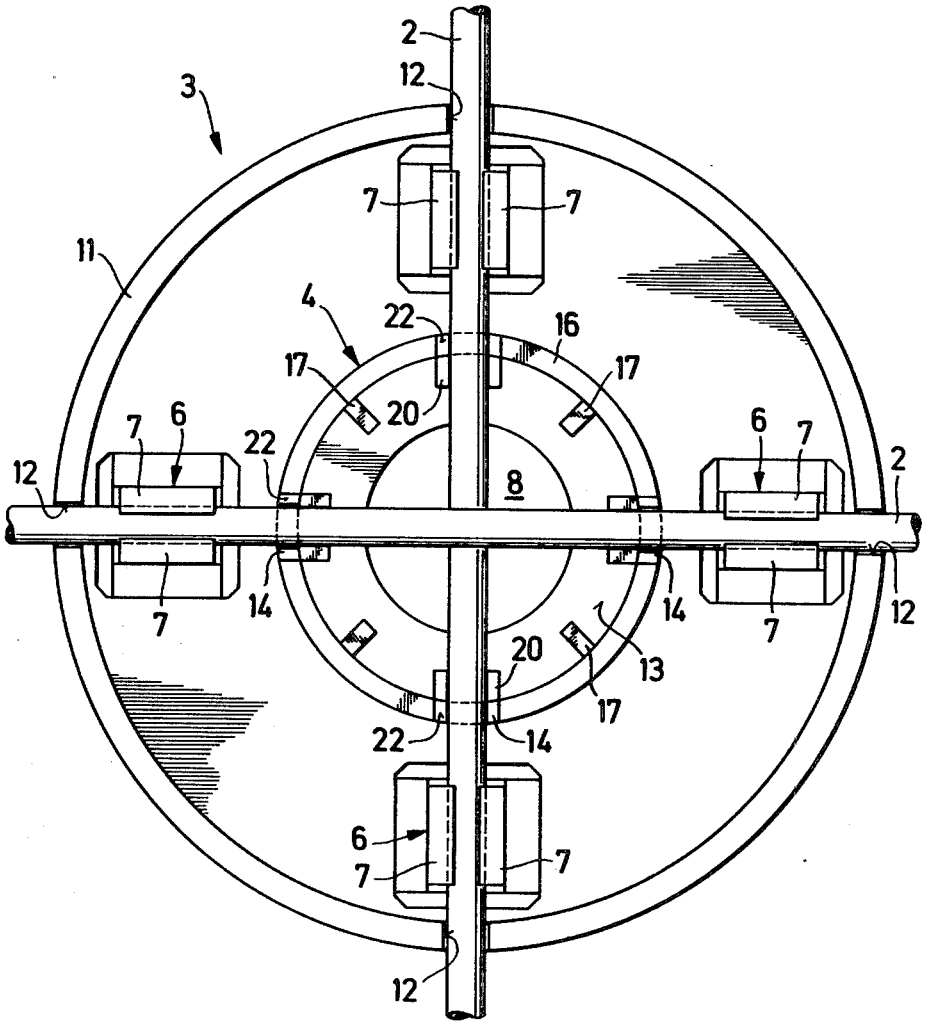
FIG. 4 is a view in the direction of arrow IV in FIG. 3.

FIG. 3 depicts a somewhat modified design of the carrier. The conical portion 15 of tubular element 4 in FIG. 2 is here replaced by tapered ribs 17. In this way the manufacture of the mold required for producing the carrier is simplified and material is saved, which also means a reduction in weight of the carrier.

The cylindrical support 5 is reinforced at its inside by ribs 21. Also, in this case tray 3 is provided at its inner surface with yokes 20 which provide additional supporting of tray 3 on the bars 2. The lead-in slots 14 in the bushing wall are enlarged conically at the outer end 22 and facilitate the introduction when the carrier is deposited on the bars, particularly if the bars are not arranged at right angles to each other.

To ensure that the trays formed according to the invention can also be easily stacked when not in use, the inside diameter of cylindrical wall 16 of bushing 4 is larger than the outside diameter of cylindrical support 5 for the lower sleeve end. The cylindrical wall 16 of tubular element 4 slips over the cylindrical support 5, and the conical part 15 (FIG. 2) or the ribs 17 (FIG. 3) come to rest on the upper edge of support 5.

Figure 5:
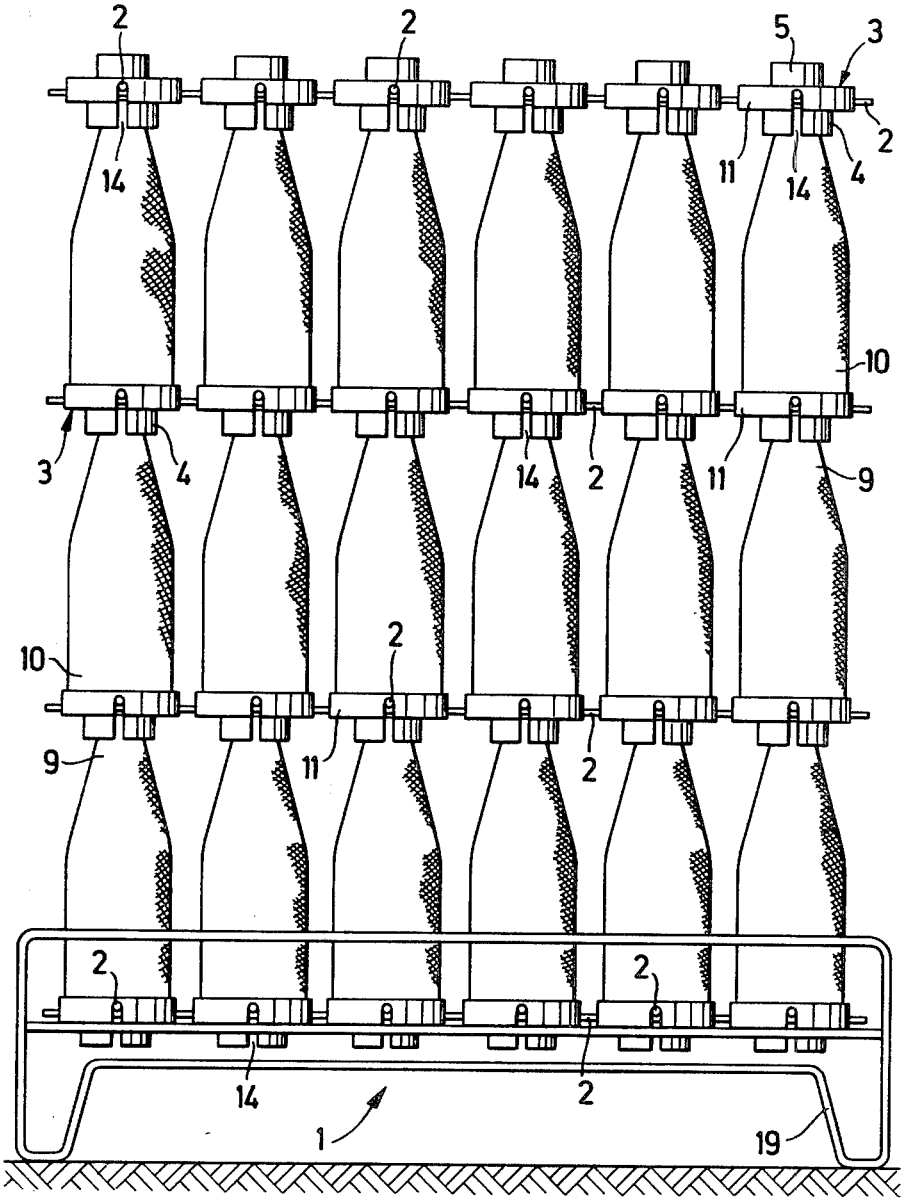
FIG. 5 is a schematic side elevation of a stack of several devices in accordance with the invention and of yarn spools arranged between them.

If the spools sitting on the pallets are to be treated in some way, for instance steamed, it is practical to provide the tray with a thin felt disc 23 of about 2–3 mm thickness which absorbs the condensate formed during the treatment. Due to the fact that the diameter of the tray is chosen to suit the diameter of the spool, no condensate can drip from the sleeve on the yarn bodies beneath it, such as can happen, for instance, in the case of the device in accordance with German Pat. No. 1,962,280. FIG. 5 shows a stack with four pallets, for accommodating three rows of yarn spools. The pallet stack rests on a supporting frame 19.

By designing the carrier as a tray, the spools are very stable not only during transportation within the shop, but also during shipment to customers, and the pallet thereby has a corresponding lateral stability.

The device in accordance with the invention is particularly well suited for transporting and treating (for instance steaming) of yarn and strand spools of up to 10 kg weight and of tapered or bottle shaped design.

We claim:

1. A one piece carrier device for support of spools on a grid-work of crossed support bars, said carrier device comprising a flat, plate-like tray adapted to rest on the support bars at an intersection of two of said bars, an upper spool guide extending upwardly from the tray, a lower spool guide extending downwardly from the tray, a central axial bore extending through said tray and said upper and lower spool guides, said lower spool guide having pairs of elongated vertical slots arranged to receive said intersecting bars, resilient gripping devices comprising pairs of resilient jaws downwardly depending from said tray at positions outboard from said axial bore, said jaws being adapted to resiliently grip said support rods at positions equidistantly spaced from said axial bore.

2. Equipment according to claim 1 wherein the first spool positioning device is dimensioned to fit within the hollow core of the upper spool and the central recess is in the second spool positioning device whereby the second spool positioning device fits over the top of a spool.

3. Equipment according to claim 1 wherein said rod gripping devices are located in the outer third of the tray diameter.

4. Equipment according to claim 3 wherein said tray is formed of polypropylene.

5. Equipment according to claim 1 wherein said tray is provided with a downwardly projecting flange around the periphery thereof, said flange having vertical slots aligned with the support rods with the bottoms of the slots resting on the rods.

* * * * *